US005212896A

United States Patent [19]

Hillard et al.

[11] Patent Number: 5,212,896

[45] Date of Patent: May 25, 1993

[54] CONTROL SYSTEM FOR A WALK BEHIND TRENCHER MACHINE

[75] Inventors: Randy H. Hillard, Wichita; Howard A. Zimmerman, Belle Plaine; Robert G. Draney; Virgil J. Hill, both of Wichita, all of Kans.

[73] Assignee: Case Corporation, Racine, Wis.

[21] Appl. No.: 884,536

[22] Filed: May 15, 1992

[51] Int. Cl.[5] ..... E02F 3/16

[52] U.S. Cl. ..... 37/86; 37/83; 37/DIG. 17; 180/19.1; 74/471 XY; 74/480 R; 74/483 R; 74/850

[58] Field of Search ..... 37/80 R, 83, 86, 245, 37/DIG. 17; 180/19.1, 272; 74/850, 471 XY, 480 R, 483 R

[56] References Cited

U.S. PATENT DOCUMENTS

| | | | |
|---|---|---|---|
| 2,749,756 | 6/1956 | George | 37/DIG. 17 |
| 3,942,604 | 3/1976 | Black | 180/272 |
| 4,062,135 | 12/1977 | Dobberpuhl | 37/245 |
| 4,203,291 | 5/1980 | Youngers | 74/471 R X |
| 4,255,879 | 3/1981 | Greider | 37/245 |
| 4,279,179 | 7/1981 | Marto | 74/850 |
| 4,553,448 | 11/1985 | Youngers et al. | 74/480 R |

*Primary Examiner*—David H. Corbin
*Assistant Examiner*—Arlen L. Olsen
*Attorney, Agent, or Firm*—Rudnick & Wolfe

[57] ABSTRACT

A control system for regulating starting and various operations of a walk behind and self-propelled trencher. The control system conditions the trencher for forward, neutral, and reverse operation through use of a single control lever mounted for sliding movement in a common plane extending between a neutral/start position and a drive position and thence in another plane to forward or reverse positions to control the direction of the trencher. When the control lever is in a neutral/start position, a power assembly on the trencher is ineffective to drive wheels used to propel the trencher across a field. When the control lever is shifted to a drive position, a drive path is established between the power assembly and at least one of the wheels on the trencher. The control system is configured to allow the power assembly to be started only when the control lever is in a neutral/start position and prevents starting of the power assembly when the control lever is in other than a neutral/start position. The control system further includes a chain assembly control member whose position relative to a disengaged condition regulates operation of an endless digging chain assembly mounted on the trencher. The control system is further configured to monitor the position of the chain assembly control member and allow for starting of the power assembly only after the chain assembly control member assumes a predetermined position relative to the single control lever used to propel the trencher.

21 Claims, 5 Drawing Sheets

CONTROL SYSTEM FOR A WALK BEHIND TRENCHER MACHINE

FIELD OF THE INVENTION

The present invention generally relates to a portable trenching machine and, more particularly, to a system for controlling starting and various operations on the trenching machine.

BACKGROUND OF THE INVENTION

It is often necessary to dig trenches to bury conduits for electrical power hook-ups, or for burying similar cable-like conduits such as television antenna cables, telephone cables, water supply pipes, and lawn sprinkling system pipes. A conventional trenching apparatus includes a boom assembly mounted on and extending rearwardly from a relatively large tractor or back hoe, frequently of the track type.

Where the area in which the trench is to be provided has already been landscaped and especially when only a relatively narrow trench of reduced depth is required, conventional trenching machines are excessively large and cause a much greater amount of destruction to existing landscaping than is necessary. Relatively large vehicles such as back holes and the like do not readily adapt to certain types of terrains such as steeply sloped or terraced areas. Moreover, the hourly cost of operating large equipment is often not just justified when only a relatively narrow ditch having a reduced depth is to be dug thereby.

There is an increasing demand, therefore, for a portable, walk behind trencher machine. Such a machine typically includes a self-propelled and wheeled frame. A power source such as a small pull/start internal combustion engine is typically mounted on the frame for driving the trenching tool i.e., an endless digging chain designed to dig a relatively narrow trench for use in situations such as those mentioned above. The digging chain is commonly mounted on a boom which is movable to different elevational positions.

In larger trencher machines, the controls for operating the trencher are typically located in a cab region of the machine away from the digging chain assembly. In contrast, and primarily because of the vast differences in their sizes, portable or walk behind trenchers typically have the controls for the machine in proximity to the engine and trenching tool on the machine. Such controls typically include one or more ground drive controls for regulating direction and speed of the trenching machine, a digging chain control for regulating operation of the digging chain assembly, and a boom lift controller for regulating the elevation of the boom relative to the frame and the digging chain assembly carried thereby thus regulating the depth of the trench being dug by the trenching machine.

On conventional trenchers, the ground drive control and digging chain control are complicated by each having a control switch or monitor associated therewith and responsive to movement thereof. Conventional trenchers further include an electrical system which includes and is responsive to the switches or monitors associated with the control levers. Inexperience with the machine and/or the routineness of trenching operations, can lead to careless mistakes by the operator and/or persons in the area of the trencher. Therefore, unless both switches detect or monitor that the respective control member is in a neutral position, the electrical system will inhibit starting of the power system.

As will be appreciated, the control levers associated with conventional trenchers are often shifted to change trencher operations. That is, the ground drive control is often shifted between forward and reverse through a neutral position or condition. Likewise, during trencher operations, the digging chain control lever is often shifted from its disengaged condition to effect operation of the digging chain. The continuous shifting of the control levers during trencher operations applies a relatively high cyclic loading on the switches or monitors of the electrical system. Failure of one or both of the switches results in costly downtime of the trencher to effect repairs thereof. Moreover, failure of either or both switches during a starting procedure can result in inadvertent starting of the trench yielding undesirable conditions.

Thus, there is a need and a desire for a simplified and reliable control system which permits starting of a walk behind trencher machine only after certain starting criteria are satisfied.

SUMMARY OF THE INVENTION

In view of the above, and in accordance with the present invention, there is provided a control system for regulating starting and various operations of a walk-behind and self-propelled trencher for digging elongated trenches and the like. The trencher includes a mobile frame with a power assembly for providing motive power to at least one of two wheels on the frame thereby propelling the trencher. The control system of the present invention conditions the trencher for forward, neutral, and reverse operation. To simplify trencher operation, the control system includes a single control lever mounted for sliding movement in a common plane extending between a neutral/start position and a drive position and thence in another plane to forward or reverse positions to control the direction of the trencher. When the control lever is in the neutral/-start position, the power assembly is automatically disengaged from driving the trencher wheels or other trencher components. When the control lever is shifted to a drive position, a drive path is established between the power assembly and at least one of the wheels. Speed and direction of the trencher is thereafter controlled by shifting the control lever a desired amount in forward and reverse directions. An important aspect of this invention concerns a control system which embodies first operative means for disabling starting of the power assembly unless the single control lever is in a neutral/start position.

The trencher further includes an endless digging chain assembly mounted on the frame. Preferably, the digging chain assembly is mounted on a movable boom assembly whose elevation controls the depth of the trench being dug by the chain assembly. The digging chain assembly is likewise driven by the power assembly.

The control system of the present invention further includes a chain assembly control member which is normally urged toward and is movable from a disengaged condition for causing the power assembly to drive the chain assembly. Another salient aspect of the present invention concerns a control system including second operative means operable in combination with the first operative means from monitoring the position of the chain assembly control member and for allowing starting of the power assembly only after the single control lever has been moved to its neutral/start position and the chain assembly control member is in its disengaged condition.

In a preferred form of the invention, the chain assembly control member is mounted on the frame to allow pivoting movement of the control member about a fixed axis. The second operative means of the control system preferably includes an interlock movable in response to movement of the chain assembly control member. The interlock is provided with a profiled configuration adapted to extend across the path of movement of and inhibit the single control lever from moving to a neutral/start position unless the chain assembly control member is moved to a disengaged condition. In a most preferred form of the invention, the interlock includes a slotted gate connected to and movable with the chain assembly control member. The slotted gate is configured to releasably accommodate a portion of the single control lever between opposite side edges thereof and has diverging cam surfaces extending angularly away from a foremost edge of the gate.

In a most preferred form of the invention, the control system includes an electrical circuit which, when completed, allows starting of the power assembly. The first operative means of the control system preferably includes a single neutral switch assembly arranged in the starting circuit. The neutral switch assembly includes a movable actuator which is responsive to movement of the single control lever in its neutral plane of movement and which completes the electrical circuit when the single control lever is in a neutral/start position. The neutral switch assembly is preferably carried by the interlock of the control system and is positioned to eliminate cyclic operation of and unnecessary wear on the neutral switch assembly due to normal and frequent shifting of the operational mode of the trencher. Moreover, the cam surfaces on the interlock protect the neutral switch assembly from damage if the single control lever is moved to a neutral/start location before the chain assembly control member is returned to a disengaged position. The starting circuit furthermore includes an ON/OFF operator controlled switch assembly preferably arranged in series with the neutral switch assembly for controlling starting of the power assembly.

The power assembly for the trencher preferably includes a first power source mounted on the frame and a second power source likewise mounted on the trencher frame and driven by the first power source. In a preferred embodiment, the first power source includes an internal combustion engine with a rotatable output drive member and the second power source includes a hydrostatic pump assembly for operably driving at least one of the wheels on the trencher in either rotational direction. The engine output member and the pump assembly are interconnected by a fist drive connection. A second drive connection is provided between the engine output ember and the digging chain assembly.

In a most preferred form of the invention, the output drive member on the engine includes a fist pulley mounted on cn output shaft of the engine. The pump assembly furthermore includes an input shaft having a pulley mounted thereon. The first drive connection preferably comprises at least one endless belt entrained about the pulley for transferring rotary motion and power therebetween. Similarly, the second drive connection comprises at least one endless belt entrained about the engine output drive member to transfer rotary motion and power to the digging chain assembly.

The control system of the present invention further includes a fist member connected to the single control lever for enabling and disabling the first drive control lever of enabling and disabling the fist drive connection in response to sliding movement of the single control lever in the common plane between neutral/start and drive positions. Moreover, the direction and speed of the trencher is controlled by the direction and extent of movement of the single control lever away from the drive position. Similarly, a second member connected to the chain assembly control member enables and disables the second drive connection between the output drive member on the engine and the chain assembly.

In a most preferred form of the invention, the single control lever of the control system is pivotally connected to a bracket which is mounted for oscillatory movement about a first axis. The single control lever is connected to the bracket for movement about a second axis extending generally normal to the first axis. Pivoting movement of the single control lever about the fist axis enables and disables the drive connection between the engine and the pump assembly. A cam arrangement is responsive to fore-and-aft movement of the lever about the second axis and regulates the output of the pump assembly thereby controlling the speed and direction of the wheels used to propel the trencher.

A shift gate is provided for positioning and positively guiding the multi-functional single control lever along a predetermined path and for movement between various positions. The shift gate preferably has a generally T-shaped configured slot with a central leg of the configured slot defining a neutral plane of movement for the multi-functional single control lever.

The boom on which the digging chain assembly is mounted is controlled by a hydraulic driver The control system of the present invention further includes a separate shiftable controller for regulating hydraulic fluid flow the driver and thereby influencing the position of the boom and the driving chain assembly relative to the frame of the trencher. In a preferred form of the invention, boom control is inactive when the first drive connection to the pump assembly is disabled.

As will be readily appreciated, a control system which utilizes a multi-functional control lever allows for simpler operation than multi-levered controls while advantageously providing equivalent functions. Configuring the path of movement of the single control lever in the manner discussed allows for desired action of the trencher to be obtained by the natural movement of the single control leer in a corresponding direction.

The control system of the present invention is furthermore simplified through use of a single sensor responsive to movement of the single control lever in a common plane and which preferably has an inter-relational effect on ground drive, chain assembly operation, had elevation of the digging chain assembly relative to the frame of the trencher. To enable starting of the power assembly, the control system logic requires the ground drive to be disengaged. Automatically disconnecting the power assembly from eh ground drive when the wiggle control lever si returned to a neutral/stat position naturally reduces parasitic loading during cold starting of the engine.

In the preferred form o the invention, the operation of the digging chain assembly is related to the position of the single control leer. Unless both the ground drive system and chain digging system are inoperative, starting of the power assembly will be inhibited. Thus, the control system substantially eliminates inadvertent movement of the trencher as well as operation of the digging chain assembly upon initial starting of the trencher.

Numerous other features and advantages of the present invention will become readily apparent from the following detailed description, the accompanying drawings, and the appended claims.

DESCRIPTION OF A PREFERRED EMBODIMENT

Figure 1:
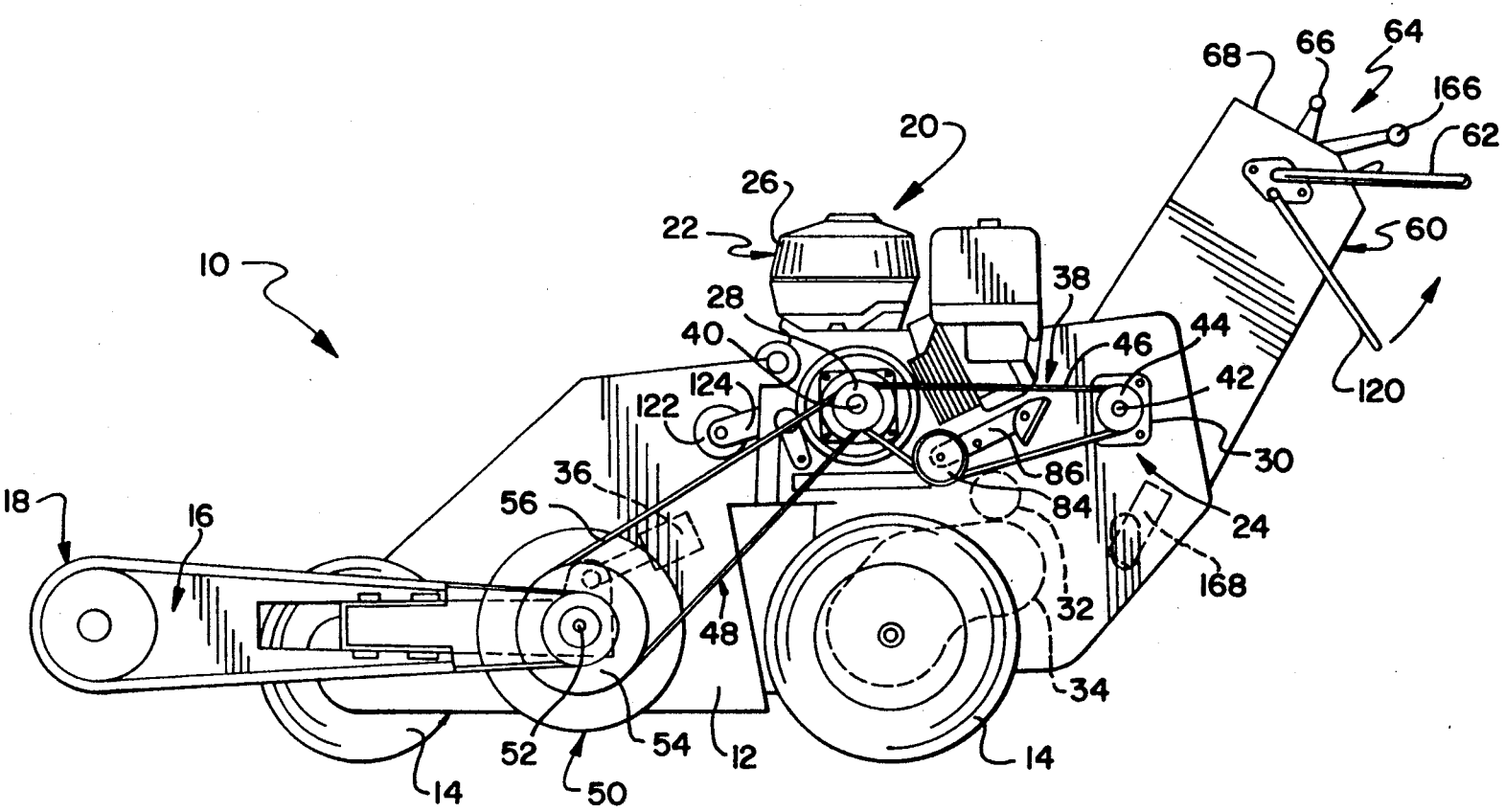
FIG. 1 is a schematic side-elevational view of a trencher according to the present invention.

While the present invention is susceptible of embodiment in various forms, there is shown in the drawings a presently preferred embodiment thereinafter described, with the understanding that the present disclosure is to be considered as an exemplification of the invention and is not intended to limit the invention to the specific embodiment illustrated.

Referring now to the drawings, wherein like reference numerals indicate like parts throughout the several views, a walk-behind and self-propelled trencher is represented in its entirety by reference numeral 10. Trencher 10 includes a mobile frame 12 supported for movement across a field by a plurality of ground engaging wheels 14. A boom assembly 16 is connected to and extends forwardly of the frame 12. The boom assembly carries a conventional endless digging chain assembly 18 for orbital movement thereabout. Trencher 10 further includes a power assembly 20 mounted on the frame 12 for providing motive power to at least one of the ground engaging wheels 14 thereby propelling the trencher and for driving the digging chain assembly 18.

In the embodiment illustrated, the power assembly 20 is comprised of first and second power sources 22 and 24, respectively, each mounted on frame 12 of the trencher. The first power source 22 is preferably in the form of a motor 26 shown as being an internal combustion engine including a rotatable output drive member 28. The second power source 24 is preferably in the form of a hydrostatic pump assembly 30 the output of which is directed over suitable hydraulic circuitry to a hydraulically driven motor 32 adapted to positively drive at least one of the ground engaging wheels 14 in either rotational direction through a conventional transaxle assembly 34 thereby propelling the trencher in forward and reverse directions. The output of the pump assembly 30 is likewise directed through suitable hydraulic circuitry to a hydraulic driver 36 preferably in the form of a doubleacting hydraulic cylinder used to elevationally position the boom assembly 16 with the digging chain assembly 18 thereon relative to the frame 12.

As shown in FIG. 1, the hydrostatic pump assembly 30 is driven by the motor 26 through a first drive connection or power train 38. In the illustrated embodiment, the output drive member 28 on motor 26 is configured as a pulley mounted on an output shaft 40 of the motor 26. As shown, the pump assembly includes an input shaft 42 having a pulley 44 fixedly mounted thereon. Drive train 38 preferably includes one or more endless belts 46 entrained about pulleys 28 and 44 for transferring rotary power and motion between the first and second power sources 22 and 24, respectively.

A second drive connection or power train 48 is provided between the power assembly 20 and the digging chain assembly 18. As shown in FIG. 1, the digging chain assembly 18 is provided at one end with a reduction drive, indicated generally by reference numeral 50, and which includes an input shaft 52 having a pulley 54 mounted thereon. The power train 48 preferably includes an endless belt 56 entrained about the output drive pulley 28 on motor 26 and pulley 54 for transferring rotary power and motion from the engine 26 to the drive chain assembly 18.

The frame 12 of the trencher 10 is configured with an enclosed hollow tower 60 and includes a fixed handlebar 62 to promote operator handling and manipulation of the trencher during operation. Handlebar 62 is provided with a generally U-shaped configuration with opposite ends being fixedly secured and extending from the tower 60 of frame 12. A control mechanism 64 including a series of operator controlled handles and levers is provided in the area of the handlebar 62 toward an upper end of tower 60 to facilitate handling of the trencher.

To facilitate multi-functional control over various trencher operations, control mechanism 64 includes a single control lever 66 which selectively conditions the trencher for forward, neutral, and reverse operations and controls the speed of the trencher. The single control lever 66 is mounted for movement along a predetermined path of movement extending between a neutral/-start position and a drive position. The single control lever 66 is furthermore mounted for movement from the drive position and away from its common plane of neutral movement to either forward or reverse positions to control the direction of the trencher.

Figures 2, 3:
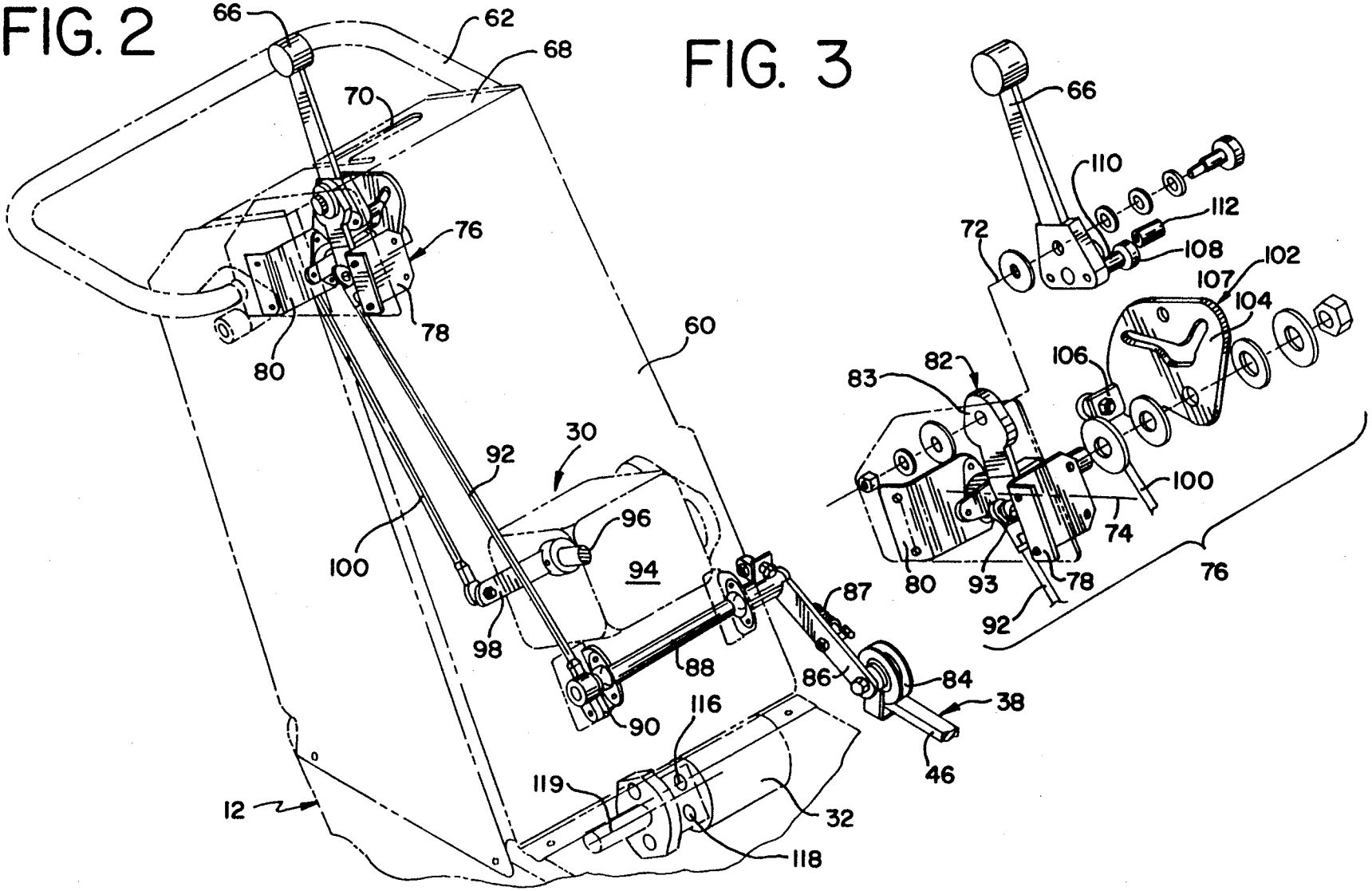
FIG. 2 is a fragmentary perspective view of a trencher embodying principles of the present invention.
FIG. 3 is an exploded perspective view of a single control lever and associated parts forming part of the present invention.

As shown in FIG. 2, a shift gate 68 closes an upper end of tower 60. Shift gate 68 functions to position and positively guide the multi-functional lever 66 along its predetermined path of movement between various positions. As shown, shift gate 68 has a generally T-shaped configured slot 70 which slidably accommodate a lengthwise portion of the multi-functional lever 66. The lateral or central leg of slot 70 on gate 68 defines the common plane of neutral movement for the multi-functional lever 66. One end of the central leg of slot 70 defines a neutral/start position for lever 66 while the opposite end of central leg of slot 70 defines a drive position for lever 66 and from whence lever 66 can be moved into a fore-and-aft extending leg of slot 70. As will be appreciated, opposite ends of the fore-and-aft ends of slot 70 govern or limit forward and reverse speeds of the trencher.

As shown in FIG. 3, the single control lever 66 is supported for rocking movement about two axes 72 and 74 extending generally normal to each other. In the illustrated embodiment, a lower end of lever 66 is mounted by framework 76 arranged within and carried by tower 60 (FIG. 2). Framework 76 preferably includes front and rear supports 78 and 80, respectively, which receive and oscillatibly support a L-shaped bracket 82 for rocking movement about axis 74. As shown, the single control lever 66 is secured to an upwardly extending leg 83 of bracket 82 for rocking movement about axis 72.

Returning to FIGS. 1 and 2, a rotatable member 84 is connected to and responds to movement of the single control lever 66 in a neutral plane and about axis 74. Member 84 is arranged in combination with the first drive connection 38 and is capable of enabling and disabling the drive train 38 established between the engine 26 and pump assembly 30 in response to selective movement of the single control lever 66 between neutral/-start and drive positions.

Figure 6:
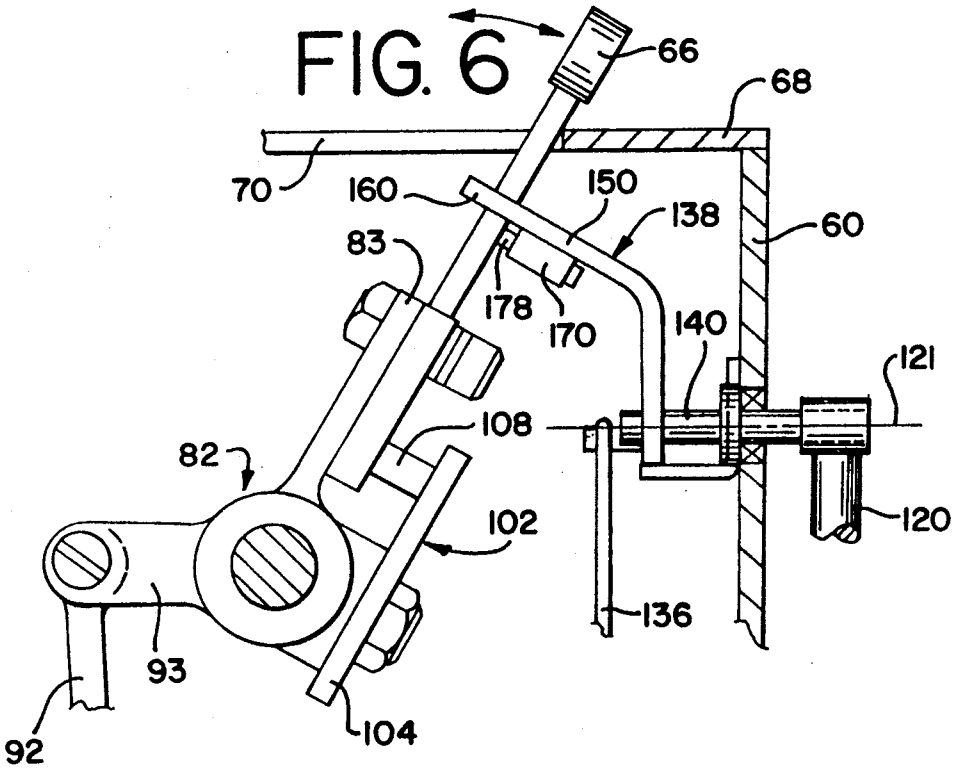
FIG. 6 is a elevational view of certain features of the present invention.

In the illustrated embodiment, rotatable member 84 is in the form of a pulley carried at a free-end of a cantilevered arm 86. A spring 87 connected to arm 86 resiliently urges pulley 84 out of engagement with the drive belt 46 of drive connection 38. The opposite end of arm 86 is connected toward one end of a shaft 88 supported for rocking movement by the frame of the trencher. An opposite end of shaft 88 is provided with a crank arm 90. One end of a control rod 92 is articulately connected, by any suitable means, to the crank arm 90 at a location radially spaced from the rotational axis of shaft 88. It is to be understood, and as shown in FIG. 6, an opposite end of control rod 92 is articulately connected, by any suitable means, to a generally horizontally extending leg 93 of bracket 82.

As will be appreciated lateral movement of the single control lever 66 about axis 74 affects oscillation or rotation of shaft 88 and thereby movement of pulley 84 in a direction extending generally normal to the belt 46 of drive train 38. When lever 66 is in a neutral/start position, pulley 84 applies substantially no tension to the belt 46 and, thus, the drive path or power train between motor 26 and pump assembly 30 is essentially disabled. When lever 66 is moved in the neutral plane to the drive position, pulley 84 is sufficiently moved to remove slack from and sufficiently tension the belt 46 such that a drive path is established between and power is transmitted from motor 26 to pump assembly 30 thus enabling the power source.

The hydrostatic pump assembly 30 preferably includes a conventional variable displacement pump 94 mounted on the frame of the trencher and connected to a fluid reservoir (not shown) likewise carried on the frame of the implement. As is known in the art, pump 94 has a displacable swashplate (not shown) for influencing the output of the pump 94. A pivot pin assembly, shown partially in the drawings and represented in its entirety by reference numeral 96, controls the position of the swashplate. As shown in FIG. 2, a pump control lever 98 is mounted on a free-end of the pivot pin assembly 96 extending beyond the housing of pump 94. As will be appreciated, the angular orientation of lever 98 controls the position of the pump swashplate and thereby the output of the pump assembly 30.

At a free-end location radially spaced from the axis of rotation of the pivot pin assembly 96, pump control lever 98 is articulately connected, by any suitable means, to one end of a pump control rod 100. An opposite end of the pump control rod 100 is connected to a cam assembly 102 which operatively interconnects the single control lever 66 with the pump assembly 30.

As shown in FIG. 3, cam assembly 102 includes a cam plate 104 which is secured to bracket 82. Cam plate 104 preferably includes a rod attachment tab 106 to which an upper end of the pump control lever 100 is particularly connected as with any suitable means. Notably, the location at which the pump control rod 100 is attached to cam plate 104 is in substantial axial alignment with the pivot axis 74 of bracket 82. Cam plate 104 further defines a cam slot 107. A pair of cam pins 108 and 110 carried by lever 66 project through slot 107 and impart pivotal movement to plate 104 when lever 66 is pivoted about axis 72. In a preferred form of the invention, cam assembly 102 further includes a spring biased detent mechanism 112 carried at a lower end of lever 66 and which acts in cooperation with a suitably shaped recess on the upstruck leg 83 of bracket 82 to define a neutral fore-and-aft position for lever 66. As will be appreciated, fore-and-aft movement of the lever 66 about axis 72 will result in endwise displacement of the pump control rod 100 and, thus, angular displacement of the pump swashplate in a manner controlling the output of the second source of power 30.

As shown in FIG. 2, the hydraulically driven motor 32 powered by pump assembly 30 is mounted on the trencher frame 12 and is provided with a pair of ports 116 and 118. Suitable hydraulic circuitry (not shown) connects ports 116 and 118 to the pump 94. Motor 32 further includes an output shaft 119 which provides motive power to the transaxle assembly 34 (FIG. 1). When pressurized hydraulic fluid from pump 94 is provided to port 116, port 118 acts as an exhaust and the motor 32 and thereby at least one of the wheels 14 on the trencher are driven in one rotational direction. When pressurized hydraulic fluid from pump 94 is provided to port 118, port 116 acts as an exhaust and motor 32 and thus at least one of the wheels is driven in an opposite rotational direction.

Figure 4:
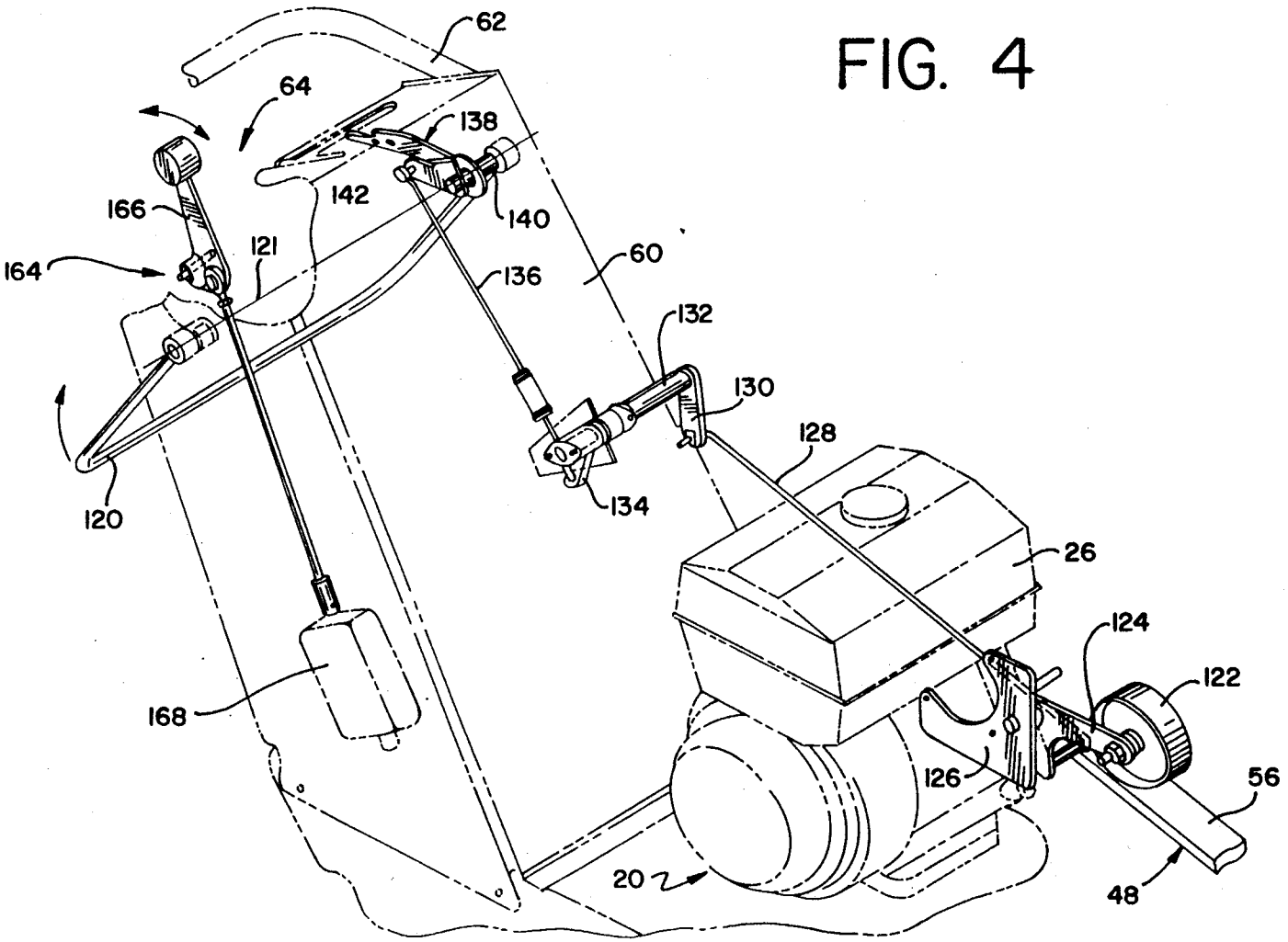
FIG. 4 is a perspective view similar to FIG. 2 but showing other features of the control system of the present invention.

Turning now to FIG. 4, the control mechanism 64 further includes digging a chain assembly control member 120. The chain assembly control member 120 is normally urged toward a disengaged condition whereat the digging chain assembly 18 is disengaged from the power source 20. The chain assembly control member 120 is movable in a predetermined path from a disengaged condition to a position causing the power assembly 20 to drive the digging chain assembly 18.

As shown in FIG. 4, the chain assembly control member 120 preferably has a generally U-shaped configuration with opposite ends thereof being pivotably mounted on the tower 60 of the trencher frame for rocking movement about a fixed axis 121. The chain assembly control member 120 is formed from solid steel to add to its weight and normally cause member to gravitate toward a disengaged condition. Control member 120 preferably has a configuration similar to and disposed proximate to the handlebar 62 to facilitate operation of member 120 through use of either hand of the operator.

A rotatable member 122 is connected to and responds to movement of the control member 120. Member 122 is arranged in combination with the second drive connection 38 and is capable of enabling and disabling the drive train established between the engine 26 and the chain assembly 18 in response to selective movement of the control member 120 from a disengaged position.

In the illustrated embodiment, rotatable member 122 is in the form of a pulley carried at the free end of one leg of a dog leg-shaped clutch link 124 mounted for pivotal movement on a fixed mounting 126. The opposite leg of link 124 is connected, by any suitable means, to one end of a push/pull rod 128. A second end of rod 128 is connected, as by any suitable means, to a free-end of a crank arm 130 extending from one end of a shaft 132 supported for rocking movement about a fixed axis by the frame of the trencher. Shaft 132 is provided with another crank arm 134 which radially extends from shaft 132. One end of a tension spring 136 is connected to crank arm 134. An opposite end of spring 136 is connected to a generally L-shaped neutral interlock 138 which is mounted for rotation in response to movement of the control member 120 and about axis 121.

The use of spring 136 in combination with control member 120 serves dual purpose. First, during normal movement of control member 120, spring 136 acts as a solid link connection between control member 120 and shaft 132 and applies a predetermined amount of force on belt 56. Second, the provision of spring 136 allows for overtravel of control member 120 without adversely affecting the force on the belt 56 of drive connection 48.

As will be appreciated, displacement of the control member 120 from its disengaged condition about axis 121 affects oscillation or rotation of shaft 132 and thereby movement of pulley 122 in a direction extending generally normal to the belt 56 of the drive train 48. When control member 120 is in a disengaged position, pulley 122 applies substantially no tension to the belt 56 and, thus, the drive path or train between motor 26 and the digging chain assembly is essentially disabled. To operate the chain assembly, control member 120 is moved from its disengaged condition and pulley 122 is sufficiently moved to remove slack from and sufficiently tension belt 56 such that a drive path is established between the motor 26 and the reduction drive 50 thereby driving the digging chain assembly 18.

Figure 5:
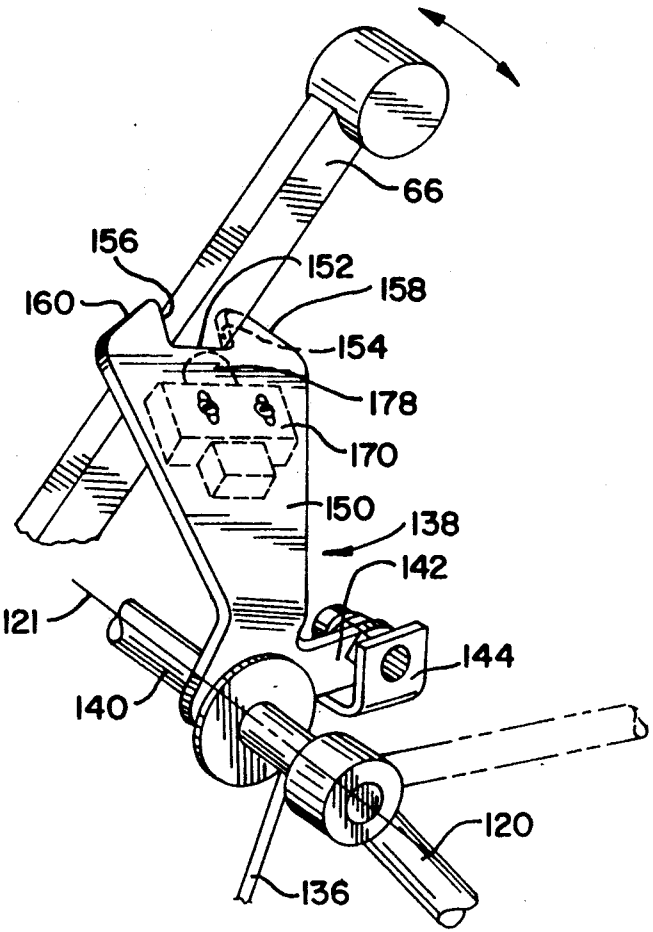
FIG. 5 is a perspective view of interrelational design features of the present invention.

Turning to FIGS. 5 and 6, the neutral interlock 138 preferably is carried on a stub shaft 140 coaxially arranged on axis 121 and to which the control member 120 is likewise connected. Thus, displacement of the control member 120 will likewise cause movement of the neutral interlock 138. As shown, spring 136 is suitably attached to a leg 142 of interlock 138. By such an arrangement, spring 136 naturally urges control member, through the interlock 138 and shaft 140, toward a disengaged condition. Spring 136 is sized to eliminate operator fatigue and to maintain proper belt tension to maximize life for belt 56. A stop 144 carried by tower 60 regulates the disengaged condition of the control member 120 as regulated by interlock 138 through engagement of leg 142 with stop 144.

As shown in FIGS. 5 and 6, interlock 138 is provided with a second leg 150 which has a profiled configuration adapted to extend across the neutral plane or path of movement of the single control lever 66. As shown in FIG. 5, leg 150 of interlock 138 is configured as a gate defining an open-sided slot 152 adapted to releasably accommodate the multi-functional lever 66 between opposite side edges 154 and 156 thereof. For purposes to be described hereinafter, leg 150 has diverging cam surfaces 158 and 160 extending angularly away from slot 152 provided at a foremost edge of leg 150.

The control mechanism 64 of the present invention further includes a boom lift control assembly, indicated generally in FIG. 4 by reference numeral 164, for controlling the elevation of the boom assembly 16 (FIG. 1). In the illustrated embodiment, the boom lift control assembly 164 includes a pivotal handle 166 which is ergonomically positioned on the tower 60 in the area of the multi-functional lever 66 (FIG. 1). As shown, handle 166 is mounted on the frame of the trencher for fore-and-aft movement and is connected to a hydraulic valve assembly 168. Valve assembly 168 is operably disposed between the pump assembly 30 of the secondary power source and the hydraulic driver 36 (FIG. 1) as by suitable hydraulic circuitry (not shown). As will be understood, the position of lever 166 conditions the valve assembly 168 to direct pressurized hydraulic fluid from pump assembly 30 of the secondary power source 24 to the driver 36 in a manner positioning the boom assembly 16 and the digging chain assembly 18 in the manner desired by the operator.

The control mechanism 64 is further designed to allow starting of the power assembly 20 only after the multi-functional lever 66 assumes a neutral/start position and the chain assembly control member 120 is a disengaged condition. As will be appreciated, preventing the power assembly 20 from starting automatically disables the system used to elevationally position the boom assembly 16 and the digging chain assembly 18 carried thereon.

Figure 7:
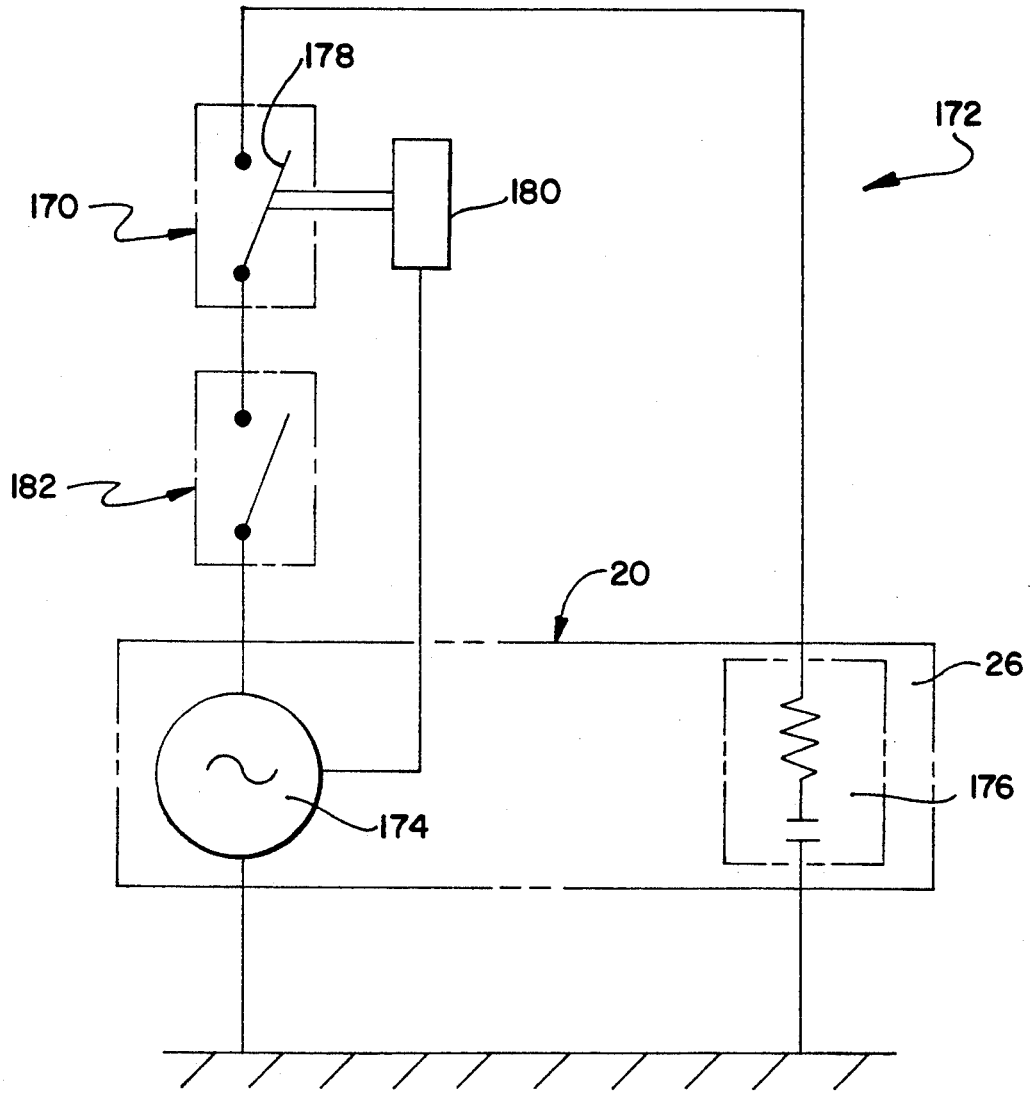
FIG. 7 is a schematic representation of one from of electrical circuitry forming part of the control system.

Control mechanism 64 has been simplified by use of a single neutral switch assembly 170. In the illustrated embodiment, switch assembly 170 is mounted on interlock 138 for monitoring both the position of the multi-functional lever 66 and the position of the chain assembly control member 120. As shown in FIG. 7, switch assembly 170 forms part of a circuit 172 which, when completed, allows starting of the power assembly 20. As is conventional, engine 26 of power assembly 20 is provided with a transistorized magneto 174 which provides an electrical output to a spark plug 176 arranged in combination with and for operating the engine 26. Switch assembly 170 includes a movable actuator 178. The position of actuator 178 is controlled by the relative positions of the multi-functional lever 66 and the chain assembly control member 120. A relay 180 maintains switch assembly 170 closed following starting of the engine 26. Circuitry 172 may further include an ON/-OFF operator control switch 182 is controlled by the operator.

Notably, circuit 172 will open and thus the engine 26 will be prevented from starting as long as switch assembly 170 remains open. Moreover, switch assembly 170 remains open as long as the multi-functional lever 66 is not in a neutral/start position. With the present invention, the multi-functional lever 66 will be allowed to reach a neutral/start position located at one end of slot 70 on guide 68 only when the chain assembly control member 120 is in a disengaged condition. As will be appreciated from an understanding of the present invention, slot 152 on interlock 138 will not be positioned to allow the lever 66 to assume a neutral/start position unless and until the chain assembly control member 120 is in a disengaged condition. When slot 152 of interlock 138 is not in position to receive the lever 66, the profiled configuration of the interlock 138 prevents lever 66 from reaching a neutral/start position.

With the present invention, open switch assembly 170 will inhibit starting of the engine 26. The inability to start engine 26, automatically disables the drive system for providing motive power to at least one of the wheels 14 to propel the trencher as well as the drive system utilized to drive the digging chain assembly 18. Because the drive system for propelling the trencher likewise provides motive power to elevationally position the boom assembly 16, the inability to start engine 26 will likewise inhibit elevationally positioning the boom assembly 16 and the digging chain assembly 18 carried thereby. The electrical circuit 172 of the present invention furthermore includes an ON/OFF operator control switch 182 which, in the preferred embodiment, must also be conditioned to allow the operator to start the power assembly 20.

Once the digging chain assembly control member 120 is in a disengaged condition, slot 152 on interlock 138 is positioned to releasably accommodate the lever 66 which can then be moved to a neutral/start position. Moving the control lever 66 to a neutral/start position closes the switch 170 and completes the circuit 172 leading to the engine power source or assembly.

In the present invention, a hydraulic drive system is used to provide motive force to the wheels 14 and propel the trencher across a field. An advantage of the present invention is that the ground drive system is automatically disconnected from the engine when the control lever 66 is in a neutral/start position and thereby parasitic loading of the engine is eliminated during starting and cold cranking conditions.

Another advantage of the present invention being the mounting of the switch assembly 170 on the interlock 138. By mounting the switch assembly 170 on the interlock 138, only one switch is required for monitoring the positions of both the ground drive control lever 66 and the chain assembly control lever 120 thereby simplifying the control system through elimination of additional parts. The diverging cam surfaces 158 and 160 on the interlock 138 protect actuator 178 on the sensor assembly 170 against damage. That is, the diverging cam surfaces 158 and 160 will inhibit engagement of the lever 66 with the actuator 178 on switch assembly 170 when the ground drive control member 120 is disengaged before the control member 66 is disengaged. Moreover, mounting the neutral/start switch assembly 170 on interlock 138 protects against cycling of the switch assembly upon each change in the operation mode of the trencher.

It should be appreciated that the drive trains 38 and 48 can take alternative forms from that illustrated. As will be appreciated, a series of intermeshing gears could likewise used to transfer rotary motion and power in the same or substantially similar manner as belts 46 and 56 without detracting from the spirit and scope of the present invention. In an embodiment wherein intermeshing gears are used to transfer power, the rotary members 84 and 122 for controlling enablement of the power trains could likewise be replaced with sliding gears arranged to move into and out, engagement with other gears in the power train.

While the present invention is susceptible of embodiment in various forms, there is shown in the drawings a presently preferred embodiment hereinafter described, with the understanding that the present disclosure is to be considered as an exemplification of the invention and is not intended to limit the invention to the specific embodiment illustrated.

What is claimed is:

1. A walk-behind self-propelled trencher comprising:

a mobile frame supported for movement over ground by at least two wheels;

an endless digging chain assembly mounted on the frame for digging trenches;

power means mounted on the frame for driving said digging chain assembly and providing motive force to at least one of said wheels thereby propelling the trencher;

a control mechanism for controlling trencher speed and direction and for controlling operation of the digging chain assembly, said control mechanism including a single control lever mounted for movement along a predetermined path of movement in a neutral plane extending between a neutral/start position at one end of the neutral plane and a drive position at an opposite end of the neutral plane, said control lever further being capable of forward and reverse movements from the drive position to direct the trencher during operation, a chain assembly control member normally urged toward a disengaged condition, whereat the chain assembly is disengaged from the power means, and which is movable to a position causing said power means to drive said chain assembly, said control mechanism further including means for monitoring the positions of said single control lever and said chain assembly control member and for allowing starting of said power means only after said control lever has been moved to said neutral/start position and said chain assembly control member is in said disengaged condition.

2. The trencher according to claim 1 wherein said power means comprises an engine mounted on the frame and including a rotatable output drive member, a hydrostatic pump assembly for operably driving at least one of said wheels in either rotational direction, a first drive connection between the engine output member and said pump assembly, and a second drive connection between the engine output member and said digging chain assembly.

3. The trencher according to claim 2 wherein said engine output drive member includes a first pulley mounted on an output shaft of the engine, with said pump assembly including an input shaft having a pulley mounted thereon, and said first drive connection comprises at least one endless belt entrained about said pulleys for transferring rotary motion and power therebetween.

4. The trencher according to claim 2 wherein said second drive connection comprises at least one endless belt entrained about the engine output drive member to transfer rotary motion and power to said chain assembly.

5. The trencher according to claim 2 wherein said control mechanism further includes a rotatable member connected to said single control lever and arranged in combination with said first drive connection for enabling and disabling the first drive connection in response to movement of said control lever in the neutral plane.

6. The trencher according to claim 5 wherein said control mechanism further includes a support carried on the mobile frame of the trencher, a bracket mounted on said support for oscillatory movement about a first axis and connected to said rotatable member, with said single control lever being pivotally connected to said bracket for movement about a second axis extending generally normal to the first axis , and cam means comprising two relatively movable interconnected cam components, one cam component being connected to and movable with said single control lever and the other cam component being connected to said bracket and to said pump.

7. The trencher according to claim 1 further including a generally U-shaped handlebar whose opposite ends are fixedly secured to and extend from said frame, and wherein said chain assembly control member is configured with a generally U-shape having opposite ends secured to the frame to allow pivoting movement of the control member about a fixed axis.

8. The trencher according to claim 1 further including an electrical starting circuit which when completed allows starting of said power means, and wherein said monitoring means comprises a single neutral switch assembly arranged in said starting circuit, said neutral switch assembly including a movable actuator responsive to rocking movement of said single control lever about said first axis and which completes said circuit when said single control lever is in a neutral/start position.

9. The trencher according to claim 8 wherein said starting circuit further includes an ON/OFF operator controlled switch assembly arranged relative to said single neutral switch assembly such that actuation of both switch assemblies is required for starting said power means.

10. The trencher according to claim 1 wherein said control mechanism further includes interlock means movable in response to movement of said chain assembly control member, said interlock means having a profiled configuration adapted to extend across the path of movement of and inhibits the single control lever from moving to said neutral/start position unless said chain assembly control member is moved to a disengaged condition.

11. The trencher according to claim 10 wherein the profiled configuration of said interlock means includes a slotted gate connected to and movable with said chain assembly control member, said slotted gate being configured to releasably accommodate a portion of said single control lever between opposite side edges thereof and having diverging cam surfaces extending angularly away from a foremost edge of said plate.

12. A walk-behind self-propelled trencher comprising:

a mobile frame supported for movement by at least two wheels;

power means mounted on said frame for providing motive power to at least one of said wheels thereby propelling the trencher;

a control mechanism for selectively conditioning the trencher for forward, neutral, and reverse operation, said control mechanism including a single control lever mounted for sliding movement between a neutral/start position, whereat the power means is automatically disengaged from the wheels, and a drive position, whereat a drive path is established between the power means and at least one of said wheels, said control lever being further movable from said drive position to either forward or reverse positions to control the direction of the trencher, said control mechanism further including sensor means for allowing the power means to be started only when the single lever control is in a neutral/start position and for preventing starting of the power means when the single control lever is shifted from a neutral/start position, with said sensor means being arranged to inhibit cycling operation thereof in response to changes in the position of said lever between forward and reverse positions to reduce wear on the sensor means and thereby increasing the effective life thereof.

13. The trencher according to claim 12 wherein said power means comprises a first power source mounted on the frame and including a rotatable output drive member, a second power source driven by the output drive member of said first power source, said second power source including a rotatable output for operably driving at least one of said wheels in either rotational direction, and a drive train for transferring rotary power between said first and second power sources.

14. The trencher according to claim 13 wherein said control mechanism includes a member connected to said single control lever for enabling and disabling said drive train in response to sliding movement of said single control lever between neutral/start and drive positions.

15. The trencher according to claim 13 wherein the direction and speed of the output of the second power source and thereby the direction and speed of the trencher is controlled by the direction and extent of movement of the single control lever away from said drive position.

16. A walk-behind and self-propelled trencher for digging elongated trenches and the like, comprising:

a mobile frame supported for movement across a field by at least two ground engaging wheels mounted on opposite lateral sides of the frame;

an endless digging chain assembly mounted on a boom connected to and movable into various elevational positions relative to the frame, said boom being positioned under the influence of a hydraulic driver;

a first self-powered drive system mounted on the frame to drive said digging chain assembly;

a second drive system mounted on the frame and powered by said first drive system, said second drive system providing motive power to at least one of said wheels to propel the trencher across a field and to said hydraulic driver used to elevationally position said boom;

a control system for controlling: speed and direction of said trencher, operation of the endless digging chain assembly, and elevation of the boom and thereby the digging chain assembly relative to the frame, said control system including a multi-functional lever movable along a predetermined path in a lateral direction between a neutral/start position, whereat the first drive system is ineffective to provide power to the second drive system, and a drive position, whereat the first drive system is effective to deliver power to said second drive system, said multi-functional lever likewise being movable in fore-and-aft directions from said enabled position and about a second axis extending generally normal to said first axis to control the speed and direction of the trencher, an operator controlled and movable handle for selectively controlling the operation of said second drive system whereby controlling operation of the digging chain assembly, and a lever for controlling fluid flow to said hydraulic driver from said second drive system and thereby controlling the elevation of the boom, and means for preventing start-up of either of said drive systems until said multi-functional lever assumes said neutral/start position and said operator controlled handle has been moved into a predetermined relationship with said multi-functional lever thereby reducing parasitic loading of the first drive system during a starting mode of the trencher.

17. The trencher according to claim 16 wherein said preventing means comprises an interlock movable with said operator controlled handle and having a profiled surface extending across the path of movement of the multi-functional lever, said profiled surface on said interlock being configured with a slot allowing said multi-functional lever to assume a neutral/start position when said operator controlled handle is positioned to disengage said digging chain assembly.

18. The trencher according to claim 17 wherein said preventing means further includes a single switch assembly capable of controlling an output signal, said switch assembly being mounted on said interlock to inhibit cycling of said single switch assembly upon operational changes of said trencher.

19. The trencher according to claim 16 wherein the control system further includes a shift gate for positioning and positively guiding said multi-functional lever along said predetermined path, and for movement between various positions, the shift interlock having a generally T-shaped configured slot with a central leg of the configured slot defining a neutral plane movement of the multi-functional lever.

20. A method of controlling operation of a hand operated wheeled trencher having a power assembly for propelling the trencher and driving a digging chain assembly mounted on a frame of the trencher, said method comprising the steps of:

conditioning a ground drive system for forward, neutral, and reverse movement over ground through movement of a single multi-functional ground drive control movable in a neutral plane from a neutral/start position to a drive position and thence in forward or reverse directions away from the neutral plane for propelling the trencher in corresponding directions;

controlling a digging chain drive system with a trencher control movable from a disengaged condition to a position for engaging the digging chain assembly;

inhibiting the ground drive control from reaching said neutral/start position until said trencher control has been positioned in a disengaged condition; and inhibiting starting of said power assembly until said ground drive control has been positioned in said neutral/start position.

21. The method for controlling operation of a hand operated wheeled trencher according to claim 20 further including the step of :

disengaging the ground drive system automatically upon movement of the ground drive control in a neutral plane from said drive position to said neutral/start position thereby reducing parasitic loading of the power assembly during starting.

* * * * *